United States Patent [19]

Harrison et al.

[11] Patent Number: 4,590,748

[45] Date of Patent: May 27, 1986

[54] MACHINE FOR AND METHOD OF PACKAGING ARTICLES OR GOODS

[75] Inventors: Roy Harrison, Stoke-on-Trent; John D. Turner, Heywood, both of England

[73] Assignee: National Research Development Corporation, London, United Kingdom

[21] Appl. No.: 626,042

[22] Filed: Jun. 29, 1984

[30] Foreign Application Priority Data

Jul. 1, 1983 [GB] United Kingdom ..... 8317928

[51] Int. Cl.[4] ..... B65B 43/42

[52] U.S. Cl. ..... 53/576; 53/570

[58] Field of Search ..... 53/530, 567, 568, 570, 53/571, 572, 576, 577, 579

[56] References Cited

U.S. PATENT DOCUMENTS

| | | | |
|---|---|---|---|
| 2,982,068 | 5/1961 | Pape et al. | 53/567 |
| 3,555,775 | 1/1971 | McMillan | 53/577 |
| 3,557,526 | 1/1971 | Hartmann | 53/567 |
| 3,662,514 | 5/1972 | Goss | 53/567 |
| 3,719,022 | 3/1973 | Cherio et al. | 53/576 |
| 3,797,199 | 3/1974 | Seifert . | |
| 3,805,480 | 4/1974 | Cherio et al. . | |
| 3,919,739 | 11/1975 | Kawai | 53/530 |
| 4,027,460 | 6/1977 | Orr | 53/576 |

*Primary Examiner*—John Sipos
*Assistant Examiner*—Donald R. Studebaker
*Attorney, Agent, or Firm*—Cushman, Darby & Cushman

[57] ABSTRACT

A machine for packaging articles within material supplied in the form of a flexible tube, in which the material is transferred to the articles from a tubular shuttle. Initially the articles rest on a support carried by the shuttle, and projecting away from one end of it. During packaging the articles are restrained from moving with the shuttle, so that the shuttle passes over them until, fully covered by packaging material, they lie clear of the other end of it. There are then means for sealing both the package and the new free end of the material remining on the shuttle, removing the completed package from the path of the shuttle, returning the shuttle to its starting position and recharging the support with articles to be packaged.

5 Claims, 5 Drawing Figures

MACHINE FOR AND METHOD OF PACKAGING ARTICLES OR GOODS

This invention relates to a machine for and a method of packaging articles or goods and in particular for packaging the same in material initially provided in the form of a sleeve or tube, especially tubular netting. Heretofore the majority of machines for feeding produce into tubular netting or the like has involved the gravity feed of produce down chutes leading to the netting. With such machines produce is liable to be crushed under its own weight. They are also relatively slow in operation and present complications when it is necessary accurately to weigh packages prior to their closure and/or to provide a predetermined number of items in a pack.

It is the object of this invention to alleviate these problems.

In its broadest form a machine in accordance with this invention utilises a hollow shuttle member conveniently of tubular form on the outer surface of which a supply of packaging material is provided, a length of which is arranged to be drawn into its interior and over articles to be packaged as the shuttle is reciprocated over the same.

Figure 1:
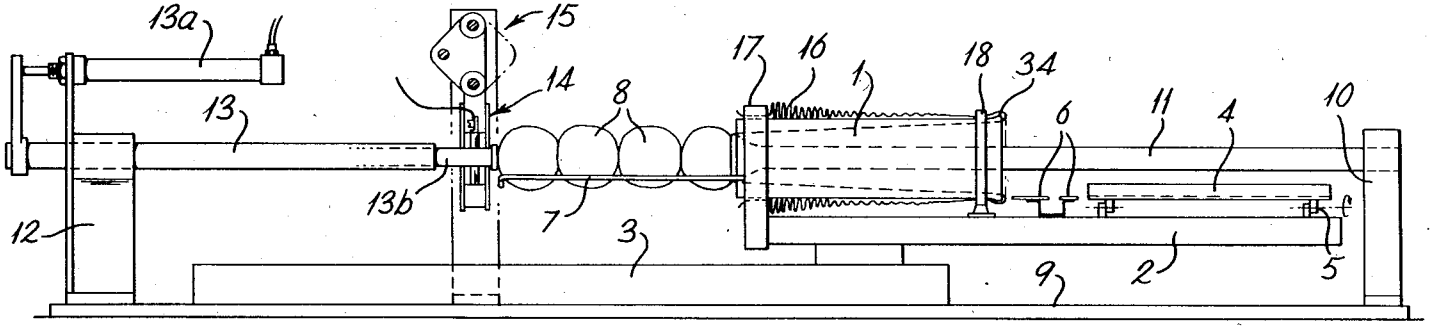
Figure 2:
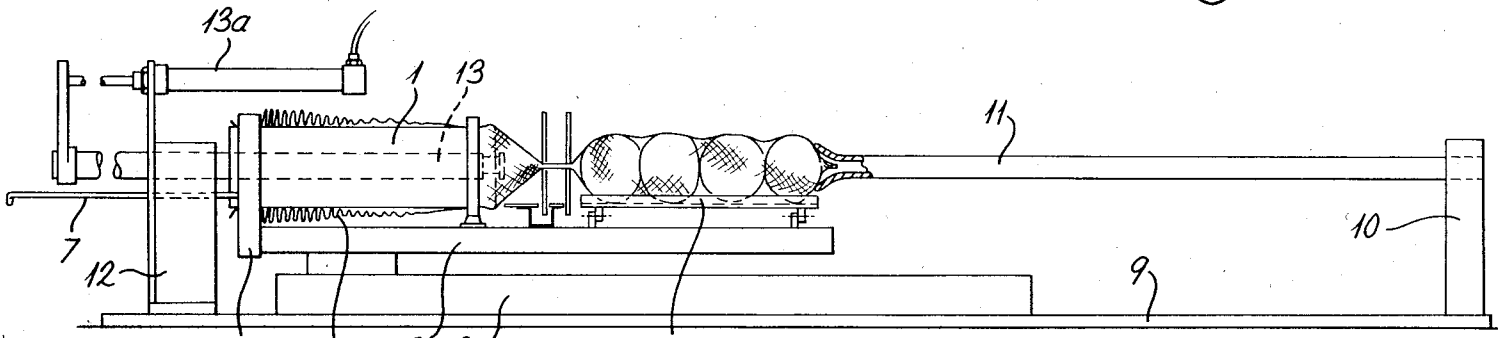
Figure 3:
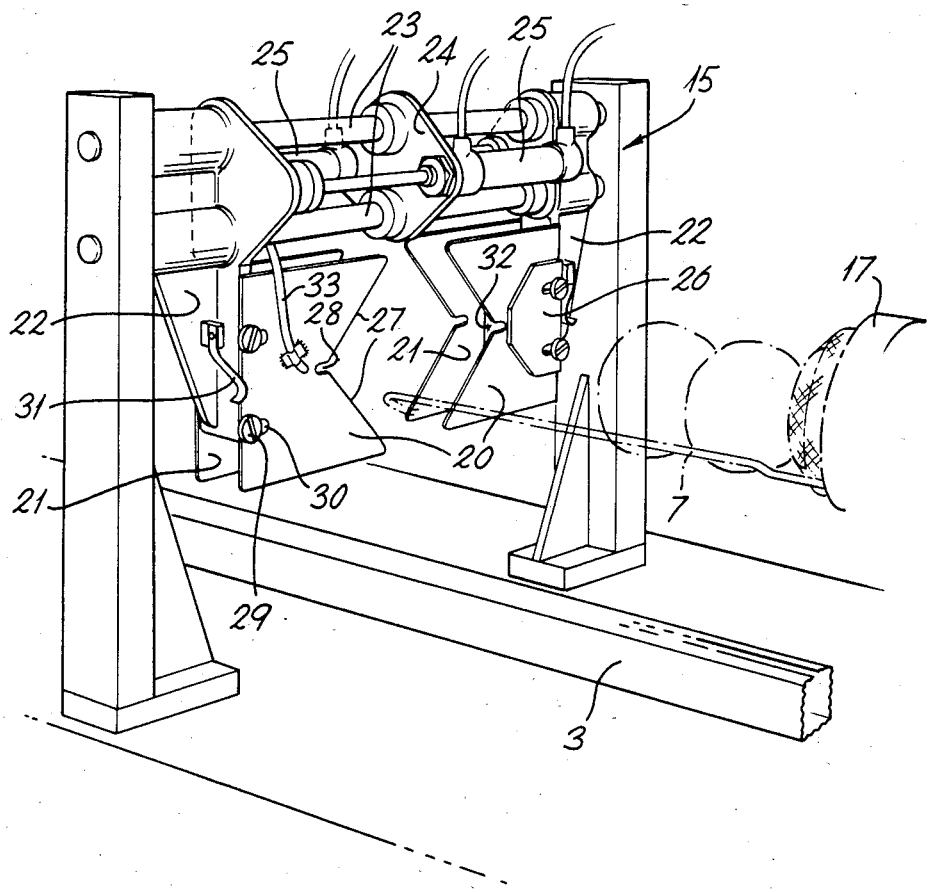
Figure 4:
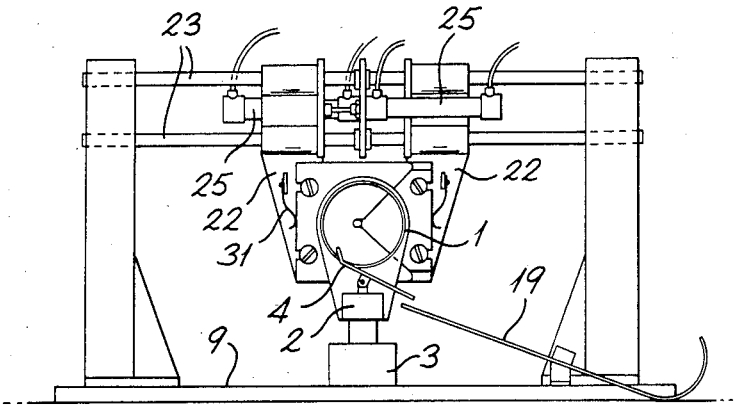
Figure 5:
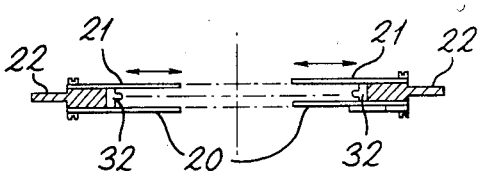

The invention is defined by the claims, the content of which is to be read as part of the disclosure of this specification, and also includes a method of packaging such as would result from the use of such apparatus. The invention will now be described with reference to the accompanying drawings in which:

FIG. 1 is a diagrammatic side elevation of a packaging machine in accordance with the invention in a first position, FIG. 2 is a similar diagrammatic elevation to FIG. 1 with the machine in a second position, FIG. 3 is a perspective detailed view of a package closure device that the machine incorporates, shown in an open position, FIG. 4 is an end elevation of the closure device of FIG. 3 as shown in the closed position, and FIG. 5 is a fragmentary sectional view of the jaws of the closure device of FIGS. 3 and 4.

Referring to the drawings, a packaging machine comprises a shuttle 1 of hollow or tubular form mounted on a carriage 2 which is arranged to be reciprocated by suitable means indicated at 3 between a first position as shown in FIG. 1 and a second position as shown in FIG. 2. A tray 4 is also mounted on the carriage 2 to the rear of the shuttle 1 and in alignment with the interior thereof, the tray 4 being tippable by pivotal movements about the pivots 5. The gap between the shuttle 1 and the tray 4 is bridged by plates 6 secured to the carriage 2. A support 7 for articles to be packed projects from the front of the shuttle 1. This support in the embodiment illustrated is formed from a bar acting as a pair of rails which has been found efficacious to support produce such as oranges 8. The support 7 may however take any variety of forms to suit articles to be packed. The means 3 for reciprocating the carriage 2 is conveniently mounted on a base 9 which may also serve to locate support structure 10 for a fixed probe 11 and a support structure 12 for a movable probe 13. A closure device 14 such as illustrated in FIGS. 3 and 4 is also mounted on the base 9 by a gantry 15.

Prior to commencing operation of the packaging machine a length of tubular netting 16 is fed on to the outer surface of the shuttle 1, one end of the netting being clamped under a collar 17 at the front of the shuttle and the other end of the netting being fed under a ring 18 which loosely embraces the shuttle at its rear end. The initially protruding length of netting will then be closed by, for example, forming a knot. The carriage 2 which will theretofore have been so positioned that the shuttle 1 was clear of the free end of the fixed probe 11 will then be moved to the position shown in FIG. 1 in which the shuttle passes over the probe drawing as it does so a length of tubing from the exterior of the shuttle into its interior. A closed end of the netting will then be presented at the front end of the shuttle. Cyclical operation of the machine may then commence.

Goods to be packaged such as the oranges 8 will be positioned on the support 7 where they will be located at one end by the probe 11 and at the other by the probe 13 which will be extended through the then open closure device 14. The carriage is then driven to its position shown in FIG. 2 during which movement the goods will be held in their initial location by the probes 11 and 13 whilst the shuttle passes over them enveloping them in the netting and then passes on to be clear of the closure device and the tray 4 is brought into position beneath the goods. The closure device 14 is then operated which brings together, seals and then severs the netting so as both to complete a package and to leave the end of the netting which will form the commencement of the next package also closed. Upon severance of the netting the tray 4 will be tipped to cause the package to drop away on to a chute such as illustrated at 19 in FIG. 4. Immediately prior to the operation of the closure device the probe 13 will of course be retracted out of the way. The return of the carriage 2 back to the position shown in FIG. 1 then sets the machine up to form a further package.

Movement of the probe may conveniently be effected by a pneumatic ram 13*a*. It has also been found advantageous to provide a telescopically arranged extension 13*b* at the free end of the probe which is resiliently urged into an extended position by, for example, air under pressure appropriately supplied to the interior of the probe. The force exerted by the probe may then be easily controlled so as to avoid damage to articles or produce located thereby. Variation in dimensions of the produce may also readily be accommodated.

The closure device 14 may be of any known form. One which has been developed for use with netting formed of thermoplastic material which it is adapted to weld and sever by heating elements is illustrated in FIGS. 3 and 4. The device essentially comprises two pairs of jaws 20, 21 arranged for reciprocation transversely to the path of the shuttle 1, the jaws being carried by brackets 22 suspended by and slidable along rods 23 of the gantry 15. A plate 24 secured in a central position on the rods 23 provides an anchorage for double acting pneumatic jacks 25 which are operated in unison to open and close the jaws.

The jaws 20, 21 are staggered as best seen in FIG. 5 so as to overlap on closure. A stop plate 26 on one jaw with which the opposite jaw engages on closure controls the nip of the jaws. The angled edges 27 of the jaws gather the tubular netting into notches 28 in which the netting is compressed. The jaws are mounted for resilient movement on the brackets 22 by screws 29 working in slots 30, the jaws being urged forwardly by springs 31. Consequently after the jaws have been closed further movement occurs in a closing direction, to the extent permitted by the length of the slots 30, of the brackets 22 which also carry heating elements 32 located between the jaws. It is thereby ensured that the netting is gathered and compacted prior to being contacted by the heating elements which serve to weld and to sever the netting so as both to seal a package and to leave a sealed end at the end of the length of netting that will form the next package.

Cooling of the weld may be promoted by air or other suitable coolant supplied for example by nozzles such as that indicated at 33. Air may also if desired by directed at the weld from the probe 13.

It will be appreciated that it is desirable for the tension of the netting or other material forming a package to be controlled so that articles or produce therein are held closely together but not so tightly as to cause damage thereto. The tension of the netting may basically be controlled as follows. First the frictional force provided by the ring 18 may be set as required to govern the force needed to draw netting from the exterior of the shuttle. This may also be governed by the shape of the rear of the shuttle as for example by providing the latter with a flared end as indicated at 34 in FIG. 1. Other frictional control means may also be provided on the shuttle if desired. Secondly the length of the shuttle in comparison with the intended length of the package should also desirably be such that the length of packaging material drawn within the shuttle should approximate to the final packet length, or if different therefrom should if anything be less than that length, it being desirable that as the shuttle clears the articles being packed further material is drawn from it under the control of the tensioning arrangements at its rear end. These arrangements may be such that the force required to draw material into the interior of the shuttle is different from the force required to draw the material straight from its rear end.

Thirdly the distance between the intended end of a package and the rear of the shuttle when in the position of FIG. 2 should be such that depending upon the closure means employed upon closure of the packaging material the desired tension is neither relaxed nor increased beyond predetermined limits. If a closure device as described in connection with FIGS. 3 and 4 is employed the spacing of the jaws needs to be such that an appropriate length of netting or other packaging material is drawn together and held whilst the heating elements are operating.

Although the packaging device illustrated is of a form suitable for packaging produce such as oranges, apples or other comparable substantially spherical produce or objects it is to be understood that the machine may in fact be adapted to package articles of any size, shape or form to the size the cross section of which the shuttle 1 will be arranged to conform. Generally of course any one machine will only be adapted to package articles within a given size range. It is intended that a supply of shuttles may be provided for any one machine on which netting or other packaging material may be preloaded, the mounting of the shuttle on the carriage 2 being such that shuttles may readily be interchanged.

Although the probe 11 has been described as fixed it is only essentially fixed in the sense that it will not normally be moved once the machine has been set up to form pre-selected packages. It may of course be rendered adjustable to suit a range of packet lengths with which the length of the shuttle will also have approximately to conform.

Although of course articles to be packaged may be placed by hand upon the support 7 associated with the shuttle it is envisaged that the feed of articles or produce thereto may be automated and in particular provision will be made to weight or count articles prior to supplying them to the support 7. Particularly when the latter is done the machine may be operated to produce packages at a considerable rate, i.e. one package in the order of 1–3 seconds.

Because the machine basically operates horizontally there is of course no danger of produce being crushed under its own weight. While in the arrangement described most moving parts of the machine are operated by pneumatic cylinders any suitable mechanism for effecting the required movement may of source be utilised incorporating necessary means for effecting their operation in the required sequence.

We claim:

1. A machine for forming a single package of a plurality of discrete articles within packaging material supplied in the form of a flexible tube, comprising:

a tubular shuttle means having first and second open ends spaced along an axis and, mounted to reciprocate parallel said axis and presenting an outer surface adapted to support a length of the material with its free end closed;

support means attached to and movable with the shuttle for supporting the whole weight of the articles immediately prior to a packaging operation in an arrangement that is coaxial with the shuttle, outside but adjacent said first open end;

means to reciprocate the shuttle and said attached support means;

means to restrain the articles from moving with the shuttle and the support means as they reciprocate, whereby on a forward stroke of that reciprocation in which the first open end leads, said support means move away from said articles and the shuttle passes the articles and material is drawn from it, closed end first, to form a tubular package around the articles as they emerge from the second open end;

means then operable to cut and seal the package around the articles, and reseal the free end of the length of the material that remains supported on the shuttle.

2. A packaging machine according to claim 1 including an abutment operable, before the shuttle begins a forward reciprocating stoke, to bear against the closed end of the supported length of material and pass through the shuttle from its second open end to the first, so addressing the closed end of the supported length to the articles to be packaged.

3. Packaging apparatus according to claim 1, including a movable table or other receiving means capable of taking up a position adjacent the second open end of the shuttle to receive the packaged articles as they come clear of the that second open end of the shuttle during its forward is forward reciprocating motion.

4. A machine according to claim 3 in which the receiving means are mounted on the same reciprocating mechanism as the shuttle itself, so that they reciprocate with it.

5. A machine according to claim 4 in which the mounting of the table or other receiving means on the reciprocating mechanism is itself movable, whereby packaged articles received by the table towards the end of a forward stroke of the reciprocating mechanism may be discharged from the table so that it is empty again before the reverse stroke of the reciprocating mechanism begins.

* * * * *